United States Patent [19]

Del Bagno, Sr.

[11] 4,299,272

[45] Nov. 10, 1981

[54] INDUSTRIAL HEAT PIPE ENERGY RECOVERY PACKAGE UNIT

[75] Inventor: Anthony C. Del Bagno, Sr., Newton, N.J.

[73] Assignee: James Howden America, Inc., East Hartford, Conn.

[21] Appl. No.: 39,703

[22] Filed: May 17, 1979

[51] Int. Cl.[3] ..... A23C 3/02

[52] U.S. Cl. ..... 165/66; 165/99; 165/103

[58] Field of Search ..... 165/95, 103, 5, 66, 165/35

[56] References Cited

U.S. PATENT DOCUMENTS 1,725,906 8/1929 Gay ..... 165/66

2,884,228 4/1959 Jorgensen ..... 165/103

3,225,823 12/1965 Frohlich ..... 165/95

*Primary Examiner*—Samuel Scott

*Assistant Examiner*—G. Anderson

*Attorney, Agent, or Firm*—Henderson & Sturm

[57] ABSTRACT

This invention relates in general to an industrial heat exchanger package unit for transferring heat energy between cool intake air flowing into an industrial process, and hot exhaust air flowing out of an industrial process. Each package units specifically includes, integral finned heat pipe heat exchangers, face and bypass damper assemblies, tilted base frames, bypass ducts, supply inlet filter assemblies, and supply inlet louver assemblies which are arranged in such a manner as to provide a percentage of total volume control over the amount of supply or exhaust air introduced into the heat exchange chambers.

1 Claim, 5 Drawing Figures

FIG. 2
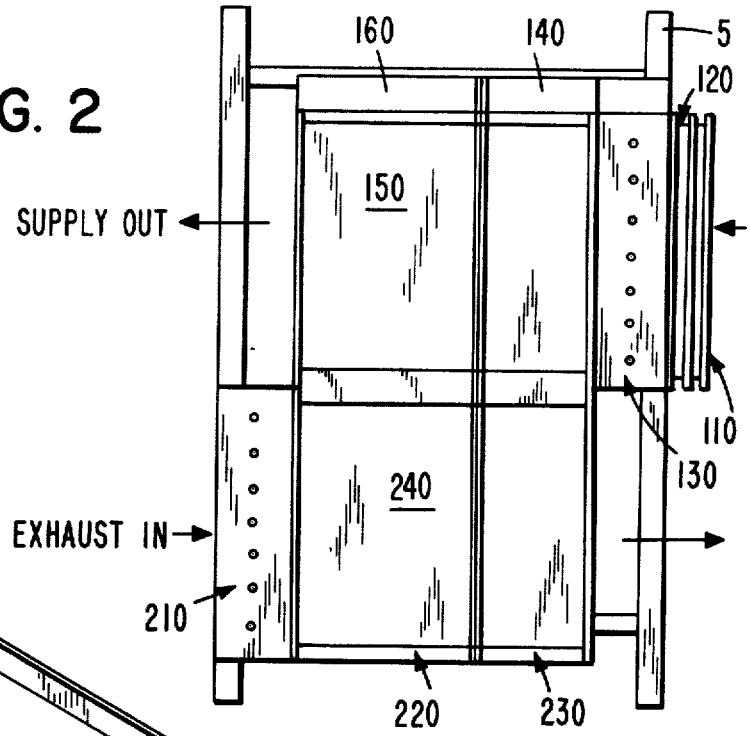
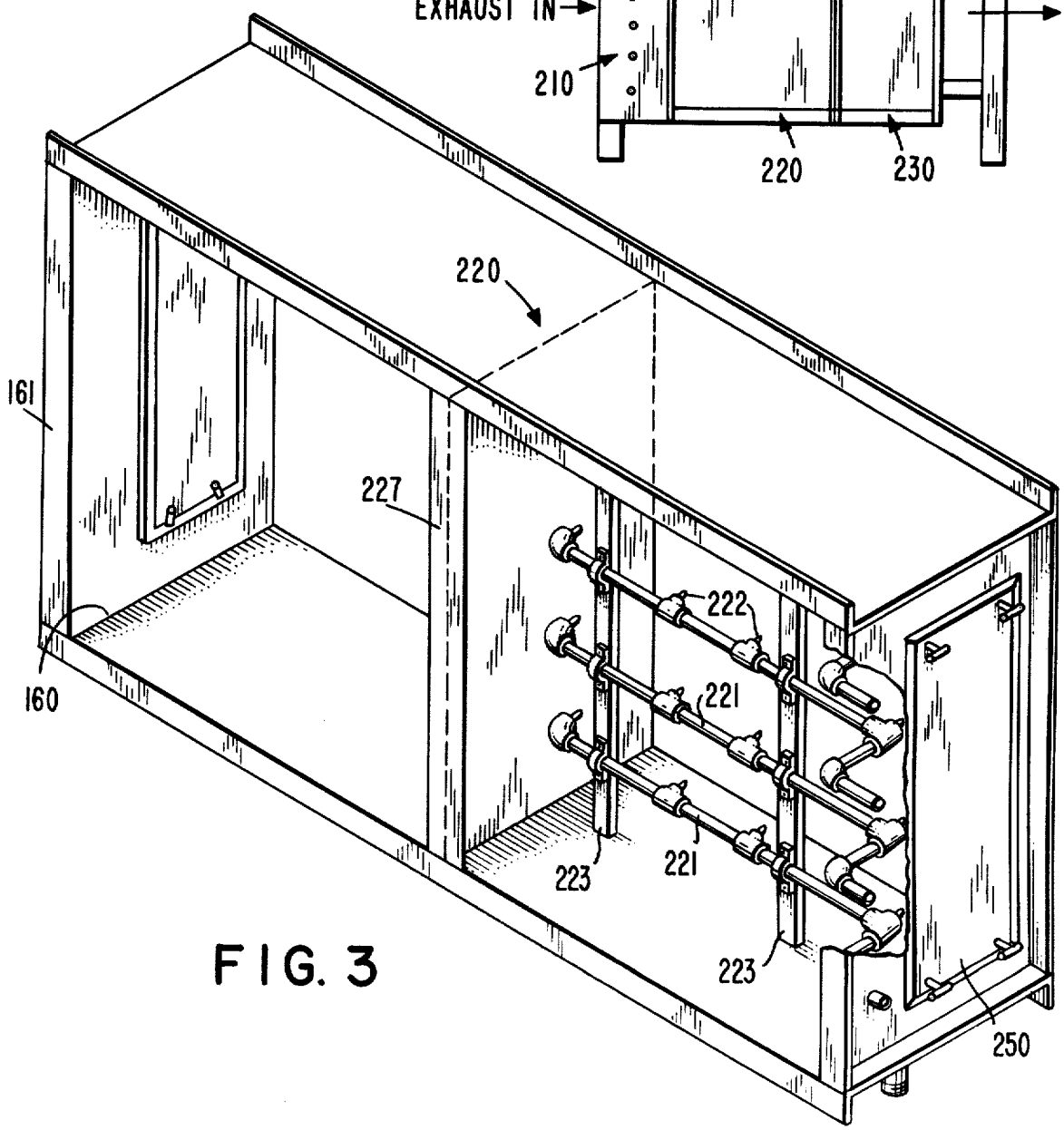
FIG. 3

INDUSTRIAL HEAT PIPE ENERGY RECOVERY PACKAGE UNIT

BACKGROUND OF THE INVENTION

Exhaust and intake systems for industrial processes, including but not limited to spray dryers ovens, kilns etc, often include air to air energy recovery heat exchangers. The function of an industrial energy recovery heat exchanger is to transfer heat energy from the contaminated, heated exhaust of the process to the incoming fresh air supply of the process. The heat energy recovered via the transfer or exchange apparatus reduces the total fuel consumption necessary to carry out the process.

In the past, heat exchange recovery packages have usually comprised one or the other of the following typical structures. In the first type a heat exchange apparatus is mounted on a wheel which is rotated to expose the heat absorbing material first to the heated exhaust and then into the path of the incoming supply air to release the absorbed heat by contact with the cooler air.

In the second type of heat exchange recovery package, two plate fin serpentine heat exchangers are utilized, fluid is pumped through the coils to transfer heat from the exhaust side to the supply side to accomplish the heat transfer.

In another type of heat exchange recovery package commonly employed a plurality of parallel sealed individual heat exchange tubes are supported at an angle to the horizontal and contain a working fluid having both a liquid and vapor phase at the working temperatures present at the inlet and outlet portions of the apparatus. Heat transfer is accomplished by evaporation of the liquid at the hot exhaust portion of the apparatus, and condensation of the vapor at the cold intake portion with subsequent return of the condensate via capillary action and gravitational forces to the lower end of the tube. The tubes are also normally provided with fin elements bonded thereto which aid in the absorption and dissipation of heat.

Some of the problems inherent in the above identified devices are; the necessity of mechanical means to rotate the heat exchanger. in one instance and pump the fluid in another, the need for rotary seals and bearing elements, difficulty in cleaning contaminants from between the fin and tube elements, thermal expansion between the fin and tube which fractures the bond between the two elements and contaminant induced corrosion between the fin and tube which can cause a failure in the whole system or an individual tube.

Some examples of prior art heat exchange recovery systems found in the prior art are U.S. Pat. Nos.: 4,040,477, 4,064.932 and 2,529,915 which are cited merely as representative samples.

BRIEF SUMMARY OF THE INVENTION

An object of the present invention is the provision of a heat exchange recovery apparatus which is easily cleaned to remove contaminants which have collected on the finned heat exchange tubes.

Another object of the present invention is the provision of a heat exchange recovery apparatus which can adjust the percentage of total volume of the supply and exhaust air which is passed through the heat exchange zones.

A further object of this invention is the provision of a heat exchange recovery apparatus which employs individual heat exchange tubes having integrally formed fin elements.

Yet another object of this invention is the provision of a heat exhaust recovery system whose efficiency can be automatically changed to maintain the exhaust air temperature above the sulpher dew point to prevent contaminants from condensing on the heat exchange tubes.

Still another object of this invention is the provision of an improved support structure within the heat exchange recovery system to suspend, space and facilitate the replacement of the individual heat exchange tubes according to the needs of a given system.

These and other objects, advantages, and novel features of the present invention will become apparent from the following detailed description of the invention, when considered in conjunction with the accompanying drawings.

BRIEF DESCRIPTION OF THE DRAWINGS

FIG. 2 is a top view of the heat exchange recovery system showing the relationship of all of the components.

FIG. 3 is a detail view of the spray washing chamber showing the spray nozzles being directed towards the exhaust heat exchange chamber.

DESCRIPTION OF THE PREFERRED EMBODIMENT

Figure 1:
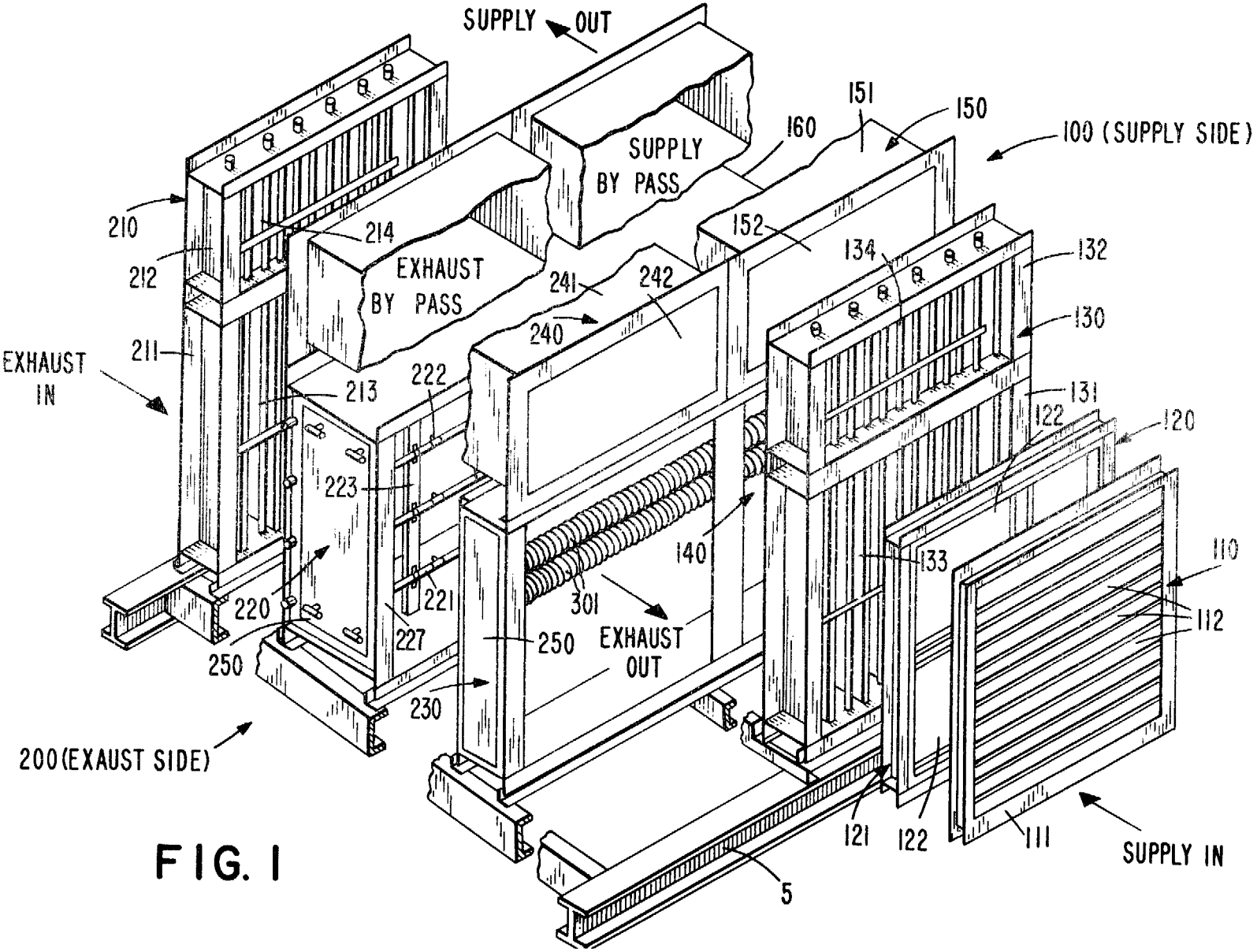
FIG. 1 is an exploded perspective view of the heat exchange recovery system of the instant invention.

FIGS. 1 and 2 illustrate a preferred embodiment of the heat exchange recovery system of the instant invention designated generally as 1, which comprises a supply side, and an exhaust side which are designated generally as 100 and 200 respectively. The combined supply side and exhaust side which comprise the assembly is supported on a pretilted base frame 5 which maintains the assembly at an angle of approximately 6° from the horizontal.

The supply side 100 comprises, (from inlet to outlet) a louver assembly 110 a filter assembly 120, a damper assembly 130 a supply heat exchange chamber 140 and a distinct but integral supply by-pass conduit 150 which runs the length of the supply side of the assembly.

The exhaust side 200 comprises (from inlet to outlet) a damper assembly 210 a spray chamber 220, an exhaust heat exchange chamber 230 and a distinct but integral exhaust by-pass conduit 240 which runs the length of the exhaust side of the assembly.

Referring now to the supply side 100 of the assembly, the louver assembly 110 comprises a rigid framework 111 which forms the face of a main air supply conduit and in which a plurality of louver elements 112 are pivotally disposed. The filter assembly 120 forms the next section of the main air supply conduit, and comprises a rigid framework 121 in which one or more filter elements 122 are removeably mounted. The supply damper assembly 130 forms the third section of the main air supply conduit and the adjustable closure for the auxiliary air supply or by-pass conduit 150 and comprises, a lower rigid framework 131 having a plurality of damper elements 133 pivotally disposed therein, and an upper rigid framework 132 having a plurality of separate damper elements 134 pivotally disposed therein. Both the upper and lower supply dampers 133 and 134 are capable of being pivoted in unison or independantly of one another. The supply heat exchanger chamber 140 forms the fourth section of the main air supply conduit, and supports one end of the rigid framework 151 which comprises the bypass conduit 150. The details of the supply and exhaust heat exchange chambers (230, 140) will be discussed further on. The supply side of the spray chamber 160, comprises rigid framework 161 which forms the outlet portion of the main air supply conduit and supports the other end of the by-pass conduit 150.

Referring now to the exhaust side 200 of the assembly, the exhaust damper assembly 210 comprises a lower rigid framework 211 which has a plurality of damper elements 213 pivotally disposed therein, forming an adjustable closure for the main exhaust air conduit, and an upper rigid framework 212 which has a plurality of damper elements 214 pivotally disposed therein, forming an adjustable closure for the auxiliary exhaust air conduit or by-pass 240. Both the upper and lower exhaust dampers 213, 214 are capable of being pivoted in unison or independantly of one another. The exhaust spray chamber 220 comprises a rigid framework 227 which forms the inlet for the main exhaust air conduit, and supports one end of the exhaust by-pass conduit 240. The exhaust heat exchange chamber 230 forms the outlet for the main exhaust air conduit, and supports the other end of the exhaust by-pass conduit 240.

Referring now to FIG. 3, wherein the spray chamber is depicted in detail, it can be seen that a plurality of spray nozzles 222 are mounted on a plurality of parallel pipes 221, which are operatively connected to a pressurized water supply, and mounted on vertical support brackets 223 attached to the rigid framework 227. The spray nozzles 222 are directed towards the heat exchange surface, and in the same direction as the flow of the exhaust gas in the main exhaust air conduit. The position of the nozzles prevents contaminants from lodging in the nozzle openings and allows the spray system to be effectively operated even when exhaust gases are flowing through the spray chamber.

Figure 4:
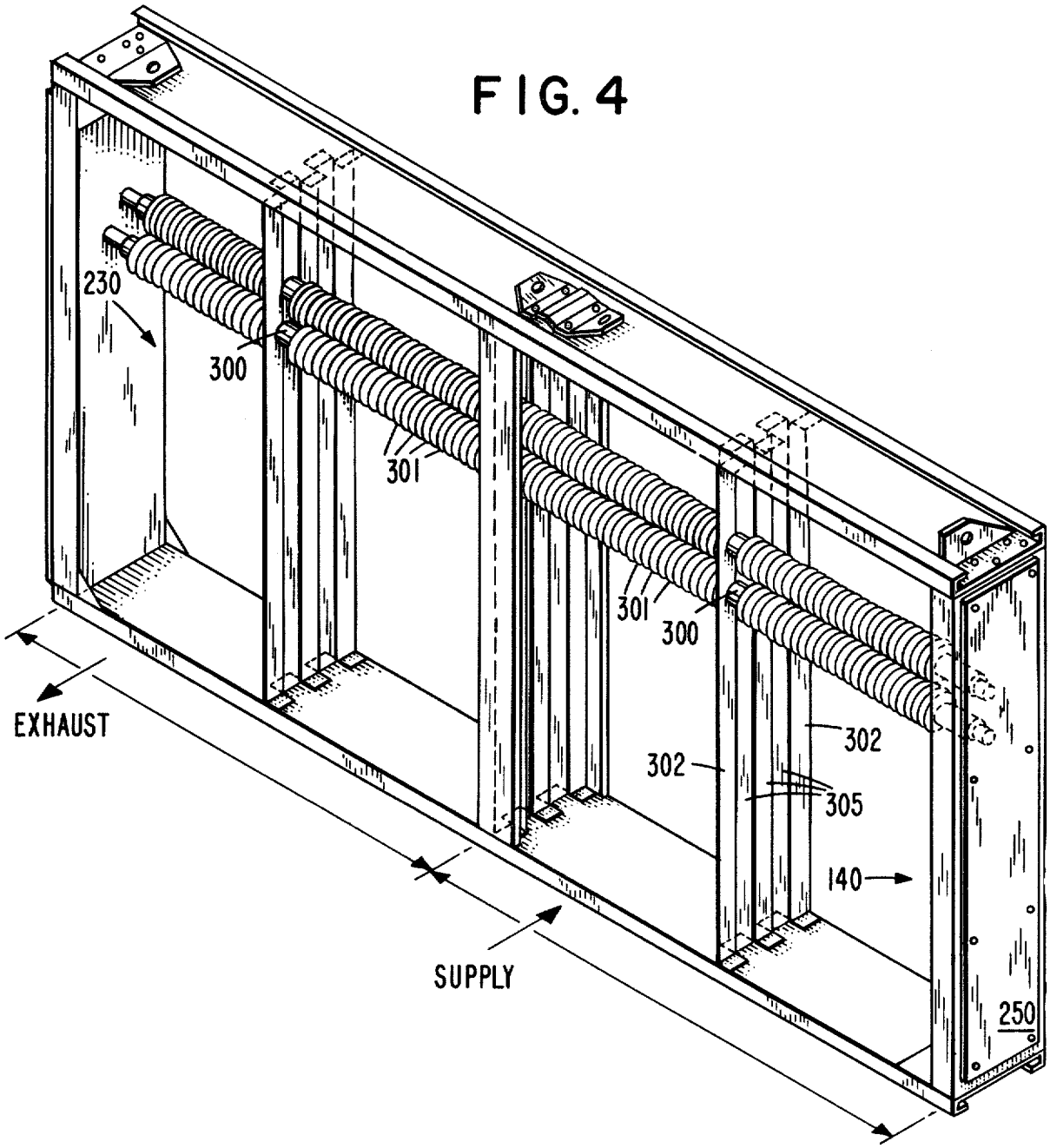
FIG. 4 is a detail view of the supply and exhaust heat exchange chambers.
Figure 5:
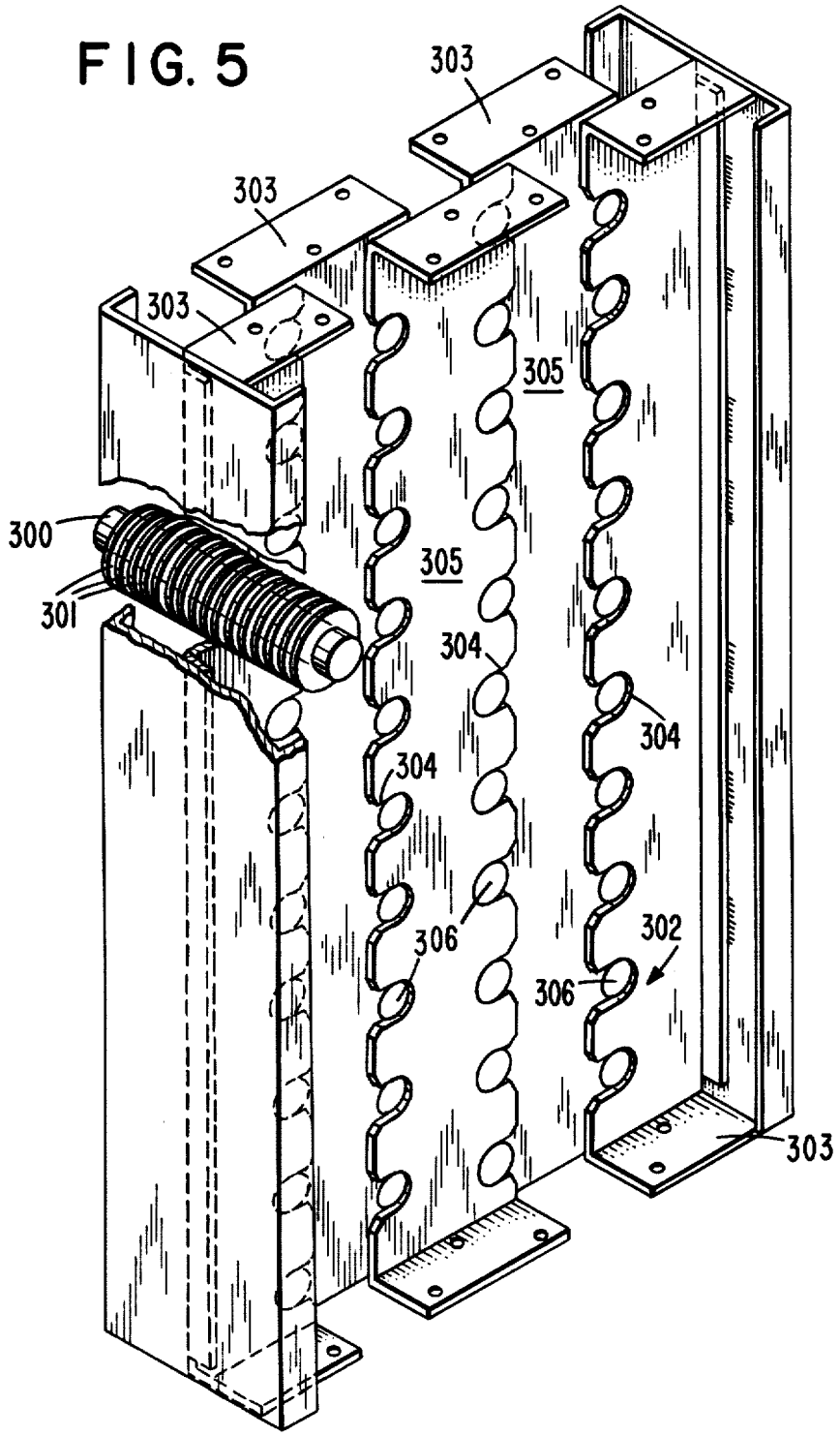
FIG. 5 is a detail view of the heat exchange tube support brackets.

FIGS. 4 and 5 show the supply and exhaust heat exchange chambers 230 and 140 wherein a plurality of individual heat exchange tubes 300 are removably secured in specially constructed mounting brackets 302 and 305.

Each of the heat exchange tubes 300 have integral, continuous, tapered fin surfaces 301 formed thereon. Due to the integral fin design maximum heat transfer from fin 301 to heat pipe tube 300 is achieved, and cleanability via the spray assembly is significantly increased due to the elimination of a tube-fin bond which would retain contaminants.

One of the improvements of this assembly over prior are devices is the flexibility in heat pipe placement to accommodate the cleaning function which is related to row depth, tube configuration and fin density, not to mention providing for repair or replacement of the individual heat pipes and/or restructuring the heat tube array for special applications and heat transfer requirements.

To this end a customized support bracket assembly has been devised which will facilitate heat tube placement, insertion and removal. The bracket assembly comprises two end brackets 302 and one more intermediate brackets 305 whose number will vary according to the row depth requirements of the specific application. The brackets are provided with mounting flanges 303 on their ends and spaced tube receiving recesses 304 along their sides. In their assembled relationship the recesses 304 in the respective brackets form circular apertures 306 which secure the heat tubes in place and accommodate the integral finned surface 301 on the heat tube.

The operation of the heat exchange assembly is as follows. The main supply air conduit will normally provide all of the supply air volume needed for the process involved so that normally the bypass conduit damper will be closed. The supply louver 110, which keeps dirt and moisture out of the assembly when it is not operation, and limits the amount of moisture taken in by the intake, is opened to allow air to pass into the assembly through the filter 122. The supply dampers 133 are opened to allow the air to pass over the heat exchange tubes towards the process zone. The output of the process zone produces heated exhaust gas containing contaminants, and these exhaust gases pass through the main exhaust conduit via the exhaust damper, spray chamber and heat exchange chamber. The exhaust gases heat the working fluid in the heat exchange tubes, and transfer heat to the supply side in well known manner, but they also deposit contaminants on the tube and fin surface which can have a deleterious effect on the efficiency of the system if allowed to accummulate over a period of time. The spray nozzles are periodically activated to wash away any contaminants on the heat tube surfaces, which prolongs the useful life of the individual tubes and the overall system as well.

Different processes have different output characteristics and the by-pass assemblies are necessary not only to handle variable supply and exhaust volumes but also to allow the process to continue while the heat exchange tubes are being repaired, replaced or rearranged. To this end access doors 250 are provided for all of the components of the heat exchange assembly.

The by-pass assemblies also allow the volume of air or exhaust which passes thru the assembly to be adjusted. Since the heat exchange system as disclosed typically achieves from 60% to 70% heat transfer efficiency, it is possible, by adjusting the exhaust air, main and by-pass dampers, to keep the exhaust air temperatures above the sulpher dew point when the process involved employs sulpher bearings fuels. This invention further provide means for automatically changing the efficiency of the heat exchange assembly to maintain the temperature of the exhaust air in the heat exchange zone at any given value.

Having thereby disclosed the subject matter of this invention, it should be obvious that many modifications, substitutions and variations to the invention are possible in light of the above teachings. It is therefore to be understood, that the invention may be practised other than as specifically described, and should be limited only by the breadth and scope of the appended claims.

What we claim is:

1. A heat exchange recovery apparatus for an industrial process comprising a main air supply conduit a by-pass supply conduit a main exhaust conduit a by-pass exhaust conduit a plurality of independant heat exchange tubes forming a heat exchange zone suspended between and extending into said main supply and main exhaust conduits wherein, said plurality of heat exchange tubes are removeably secured in brackets disposed in said main supply and main exhaust conduits, and said heat exchange tubes have integral, continuous, tapered, fin elements formed thereon wherein, said brackets have a plurality of heat exchange tube receiving spaced recesses extending along at least one edge, and the brackets in their assembled relationship form circular apertures which secure the heat exchange tubes in place and accommodate the integral fin elements formed thereon a plurality of spray nozzles disposed in said exhaust conduit upstream of said heat exchange tubes, wherein said spray nozzels are periodically actuated to wash away contaminants which have accummulated on said heat exchange tube and fin surfaces a louver assembly and filter assembly mounted upstream of said damper assembly in said main supply conduit, and said damper assemblies can be actuated; to maintain a given temperature value in the main exhaust conduit; to vary the efficiency of the heat exchange recovery apparatus and to direct all of the supply air and exhaust through the by-pass conduits to allow repair replacement or rearrangement of the heat exhaust tubes without disrupting the industrial process.

* * * * *